US011002077B2

(12) United States Patent
Woolston

(10) Patent No.: US 11,002,077 B2
(45) Date of Patent: May 11, 2021

(54) BOREHOLE CROSS-SECTION STEERING

(71) Applicant: Novatek IP, LLC, Provo, UT (US)

(72) Inventor: Scott Woolston, Spanish Fork, UT (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 159 days.

(21) Appl. No.: 16/279,168

(22) Filed: Feb. 19, 2019

(65) Prior Publication Data

US 2019/0292853 A1 Sep. 26, 2019

Related U.S. Application Data

(63) Continuation-in-part of application No. 15/935,316, filed on Mar. 26, 2018, now Pat. No. 10,633,923.

(51) Int. Cl.

| | |
|---|---|
| ***E21B 7/00*** | (2006.01) |
| ***E21B 7/06*** | (2006.01) |
| ***E21B 10/32*** | (2006.01) |
| *E21B 7/128* | (2006.01) |

(52) U.S. Cl.

CPC ..... *E21B 7/061* (2013.01); *E21B 7/001* (2013.01); *E21B 7/064* (2013.01); *E21B 10/32* (2013.01); *E21B 7/128* (2013.01)

(58) Field of Classification Search

CPC ..... E21B 7/001

See application file for complete search history.

(56) References Cited

U.S. PATENT DOCUMENTS

| | | | |
|---|---|---|---|
| 2,317,010 | A | 4/1943 | Wingard |
| 2,886,293 | A | 5/1959 | Carr |
| 4,071,100 | A | 1/1978 | Wibom |
| 4,074,778 | A | 2/1978 | Morrell et al. |
| 4,211,292 | A | 7/1980 | Evans |

(Continued)

FOREIGN PATENT DOCUMENTS

| | | | |
|---|---|---|---|
| GB | 2408757 | A | 6/2005 |
| GB | 2422388 | A | 7/2006 |

(Continued)

OTHER PUBLICATIONS

International Preliminary Report on Patentability issued in International Application PCT/US2019/023954, dated Oct. 8, 2020, 7 pages.

*Primary Examiner* — Giovanna Wright

(57) ABSTRACT

A drill bit forming a borehole in the earth may be urged sideways, creating a curve in the borehole, by a cross-sectional shape of the borehole. For example, a borehole with a cross-sectional shape comprising two circular arcs of distinct radii, one larger and one smaller than a gauge of the drill bit, may push the drill bit away from the smaller circular arc and into the larger circular arc. Forming a borehole with such circular arcs may be accomplished by extending a cutting element from a side of the drill bit for only a portion of a full rotation of the drill bit.

The relative radii and angular ranges occupied by the circular arcs may affect a radius of curvature formed in the borehole. The radii and angular ranges occupied by these circular arcs may be adjusted by altering the timing of extension and retraction of the extendable cutting element.

18 Claims, 5 Drawing Sheets

(56) References Cited

U.S. PATENT DOCUMENTS

| | | | | |
|---|---|---|---|---|
| 4,262,758 | A | 4/1981 | Evans | |
| 4,400,036 | A | 8/1983 | Bradley | |
| 4,486,050 | A | 12/1984 | Snyder | |
| 5,213,168 | A | 5/1993 | Warren et al. | |
| 5,937,954 | A | 8/1999 | Puttmann et al. | |
| 6,039,130 | A | 3/2000 | Pruet | |
| 6,484,819 | B1 | 11/2002 | Harrison | |
| 7,120,565 | B1 | 10/2006 | Shibazaki | |
| 7,409,901 | B2 | 8/2008 | Lucas et al. | |
| 7,451,818 | B2 * | 11/2008 | Addis | E21B 7/00 166/298 |
| 7,703,559 | B2 | 4/2010 | Shen et al. | |
| 7,810,585 | B2 | 10/2010 | Downton | |
| 7,849,936 | B2 | 12/2010 | Hutton | |
| 7,971,662 | B2 | 7/2011 | Beuershausen | |
| 8,087,479 | B2 | 1/2012 | Kulkarni et al. | |
| 8,141,657 | B2 | 3/2012 | Hutton | |
| 8,476,368 | B2 | 7/2013 | Klipp et al. | |
| 8,590,638 | B2 | 11/2013 | Downton | |
| 8,689,905 | B2 | 4/2014 | Krueger et al. | |
| 8,727,036 | B2 | 5/2014 | Johnson et al. | |
| 8,746,368 | B2 | 6/2014 | Johnson et al. | |
| 8,757,294 | B2 | 6/2014 | Johnson et al. | |
| 8,763,726 | B2 | 7/2014 | Johnson et al. | |
| 9,080,399 | B2 | 7/2015 | Oesterberg | |
| 9,085,941 | B2 | 7/2015 | Hall et al. | |
| 9,255,450 | B2 | 2/2016 | Jain et al. | |
| 9,279,293 | B2 | 3/2016 | Izbinski | |
| 9,708,859 | B2 | 7/2017 | Jain et al. | |
| 9,970,239 | B2 | 5/2018 | Oesterberg | |
| 10,119,338 | B2 | 11/2018 | Thomas et al. | |
| 2008/0093125 | A1 * | 4/2008 | Potter | E21B 7/001 175/67 |
| 2009/0032306 | A1 | 2/2009 | Addis et al. | |
| 2009/0057018 | A1 | 3/2009 | Farley | |
| 2010/0032207 | A1 | 2/2010 | Potter et al. | |
| 2013/0248252 | A1 | 9/2013 | Oesterberg et al. | |
| 2016/0053551 | A1 | 2/2016 | Jain et al. | |
| 2017/0175455 | A1 | 6/2017 | Jain et al. | |
| 2017/0254150 | A1 | 9/2017 | Stockey et al. | |
| 2018/0258705 | A1 | 9/2018 | Oesterberg | |

FOREIGN PATENT DOCUMENTS

| | | | |
|---|---|---|---|
| GB | 2428713 | A | 2/2007 |
| WO | 2006085105 | A1 | 8/2006 |
| WO | 2007012858 | A1 | 2/2007 |

* cited by examiner

BOREHOLE CROSS-SECTION STEERING

CROSS REFERENCE TO RELATED APPLICATIONS

This patent is a continuation-in-part of U.S. patent application Ser. No. 15/935,316 entitled "Slidable Rod Downhole Steering" and filed Mar. 26, 2018 which is incorporated herein by reference for all that it contains.

BACKGROUND

When exploring for or extracting subterranean resources, such as oil, gas, or geothermal energy, and in similar endeavors, it is common to form boreholes in the earth. Such boreholes may be formed by engaging the earth with a rotating drill bit capable of degrading tough subterranean materials. As rotation continues the borehole may elongate and the drill bit may be fed into it on the end of a drill string.

At times it may be desirable to alter a direction of travel of the drill bit as it is forming a borehole. This may be to steer it toward valuable resources or away from obstacles. A variety of techniques have been developed to accomplish such steering. Many known drill bit steering techniques require pushing against an interior surface of a borehole. This pushing often requires great amounts of energy to be expended downhole. Further, the amount of energy required may increase as a desired radius of curvature of the borehole decreases. Thus, a means for forming a curving borehole, and especially a curving borehole comprising a relatively small radius of curvature, while expending less energy downhole may prove valuable.

BRIEF DESCRIPTION

One technique for controlling a direction of travel of a drill bit as it forms a borehole through the earth may be to give the borehole a cross-sectional shape that urges the drill bit laterally. Much energy may be saved in this manner as the borehole does the urging, rather than a drilling tool. A borehole capable of urging a drill bit laterally may have a cross-sectional shape comprising two circular arcs, one with a larger radius and one with a smaller radius than that of a drilling tool passing through the borehole. The drilling tool may be pushed away from the smaller circular arc and into the open space provided by the larger circular arc. This lateral pushing may add a curve to the borehole as it is formed having a center of curvature closer to the larger circular arc than the smaller circular arc.

These two circular arcs, while centered at a common axis of the borehole, may each occupy a distinct angular range about this axis. A sharpness of the curve imparted to the borehole as it is formed may depend on the relative radii and angular sizes of the two circular arcs. Thus, the drill bit may be precisely steered by changing these relative radii and angular sizes and the rotational orientations of the two circular arcs at different positions along the length of the borehole.

Producing these two circular arcs may be accomplished by first rotating a drilling tool to bore a hole through the earth and then extending a cutting element from a side of the drilling tool during only a portion of its rotation. While extended, this cutting element may remove additional earthen material from an internal surface of the borehole to form a first of the circular arcs. While retracted, a second circular arc may be formed. Adjusting the relative radii, angular sizes and rotational orientations of these two circular arcs as the borehole is formed, to steer the drilling tool, may be achieved by altering the timing of the extension and retraction.

DRAWINGS

FIGS. 3-1 through 3-4 are cross-sectional views of embodiments of drilling tools disposed within non-circular subterranean boreholes.

FIGS. 4-1 through 4-4 are cross-sectional views of additional embodiments of drilling tools disposed within non-circular subterranean boreholes.

DETAILED DESCRIPTION

Figure 1:
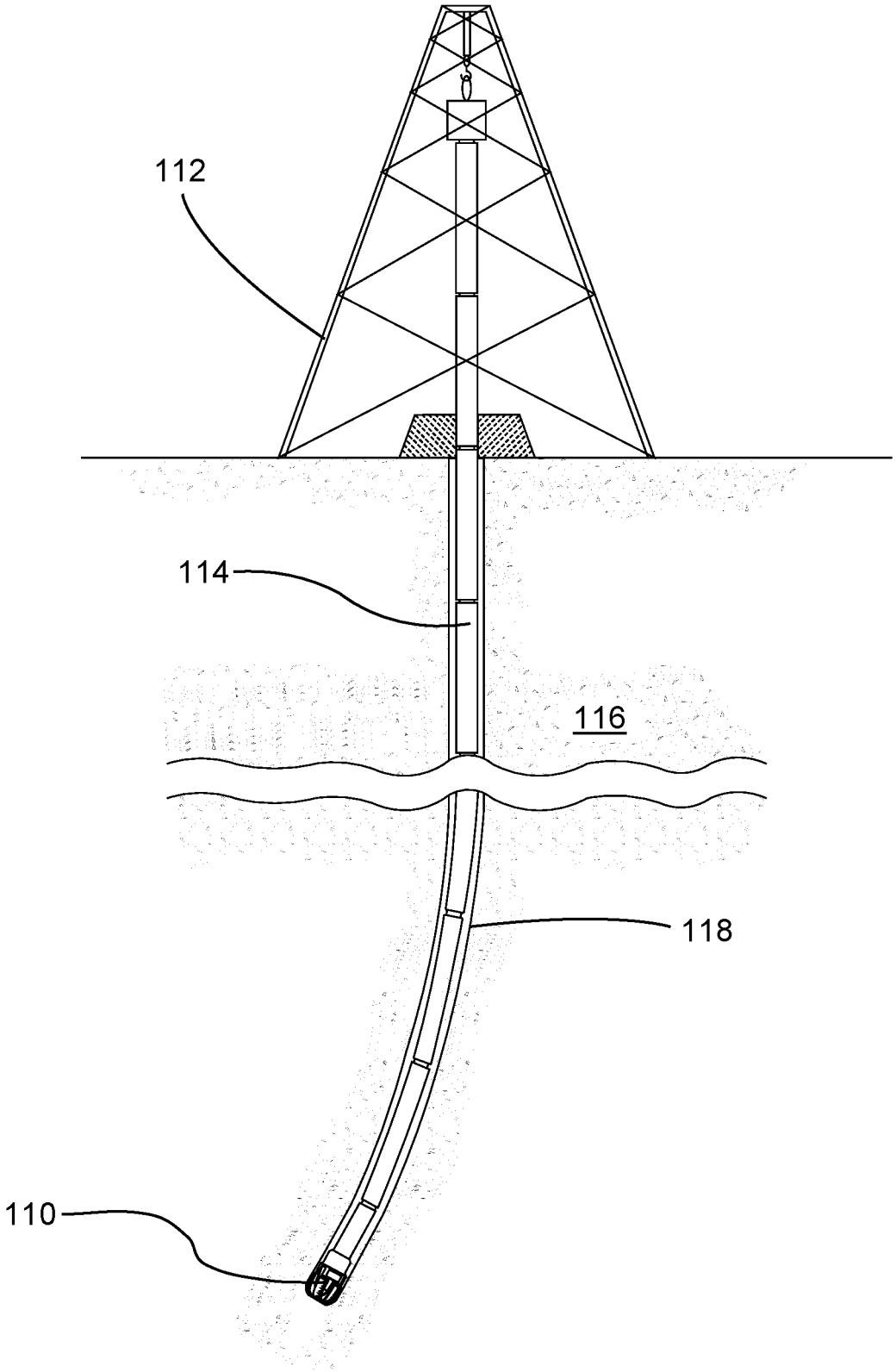
FIG. 1 is an orthogonal view of an embodiment of a subterranean drilling operation.

Referring now to the figures, FIG. 1 shows an embodiment of a subterranean drilling operation of the type commonly used to form boreholes in the earth. More specifically, a drill bit 110 is shown that may be suspended from a derrick 112 by a drill string 114. While a land-based derrick 112 is depicted, comparable water-based structures are also common. Such a drill string may be formed from a plurality of drill pipe sections fastened together end-to-end, as shown, or, alternately, a flexible tubing. As the drill bit 110 is rotated, either with torque from the derrick 112, passed through the drill string 114, or by a downhole motor, it may engage and degrade a subterranean formation 116 to form a borehole 118 therethrough.

Figure 2:
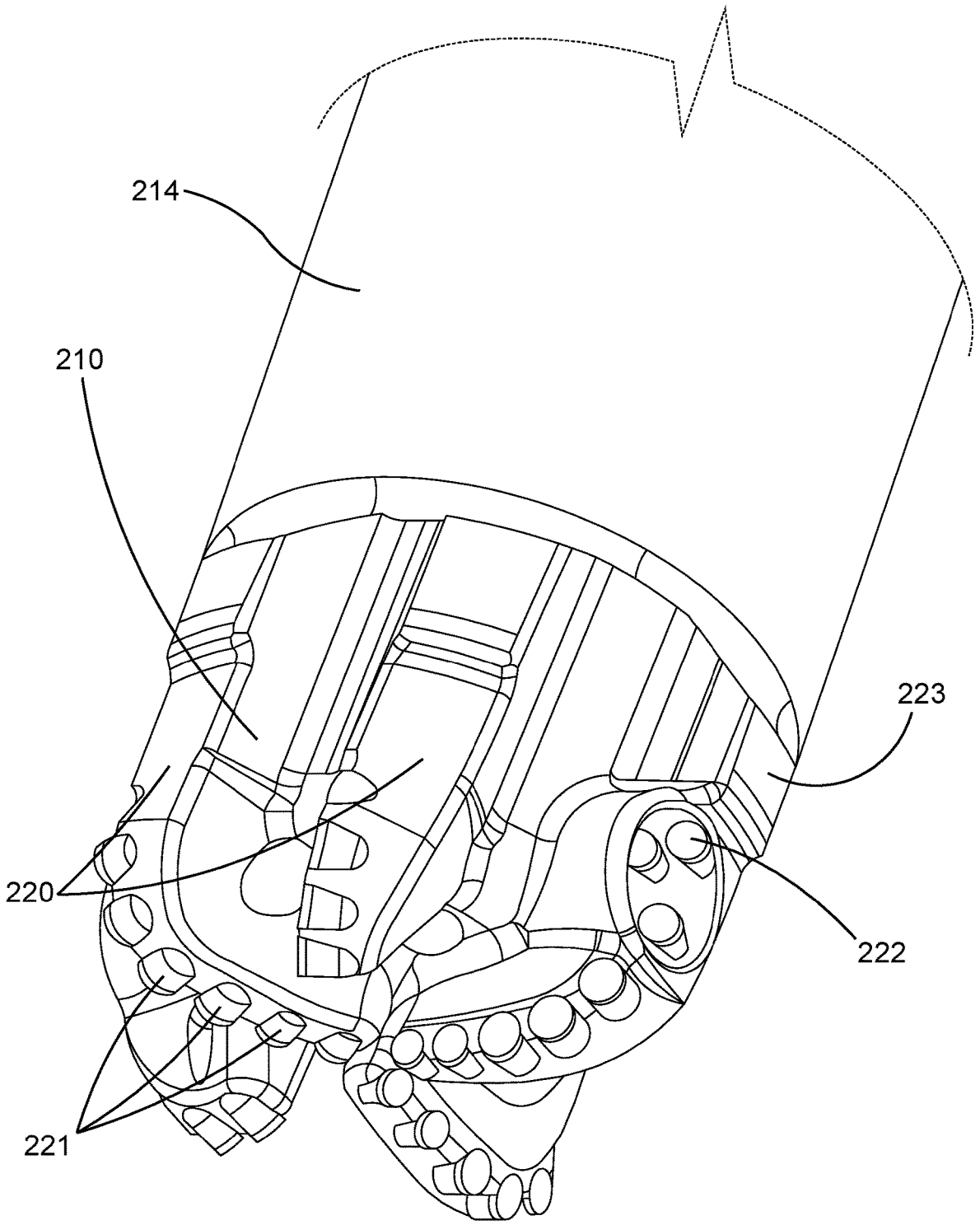
FIG. 2 is a perspective view of an embodiment of a drill bit attached to an end of a drill string.

FIG. 2 shows an embodiment of a drill bit 210 secured to an end of a drill string 214 that may form part of a subterranean drilling operation of the type just described. A plurality of blades 220 may protrude from the drill bit 210, spaced around a rotational axis thereof. Each of the blades 220 may comprise a plurality of fixed cutters 221 secured thereto capable of degrading earthen materials. As the drill bit 210 rotates, these cutters 221 may form a long hollow borehole through the earth. Such a borehole may comprise an initial radius determined by spacing between the fixed cutters 221 and a rotational axis of the drill bit 210.

At least one cutting element 222, also capable of degrading the earth, may be extendable from a side of the drill bit 210 (or another downhole tool in alternate embodiments). This extendable cutting element 222 may scrape earthen material away from an internal wall of a borehole initially formed by the fixed cutters 221. When extended, the extendable cutting element 222 may enlarge the radius of the borehole, from its initial size, in certain areas.

Figures 1, 3:
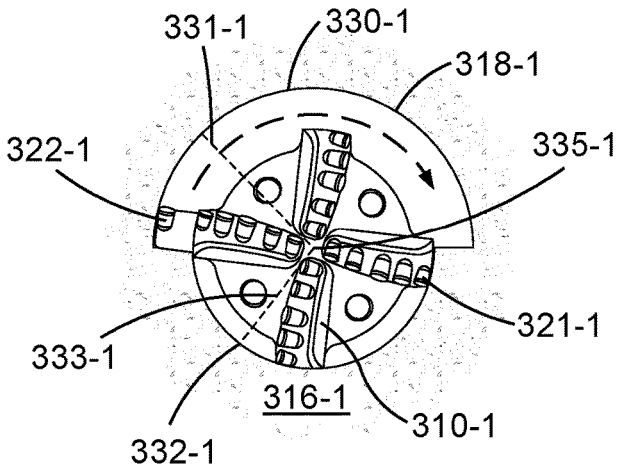
Figures 2, 3:
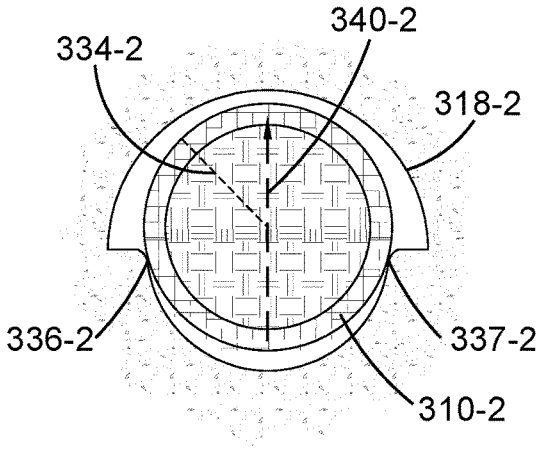
Figure 3:
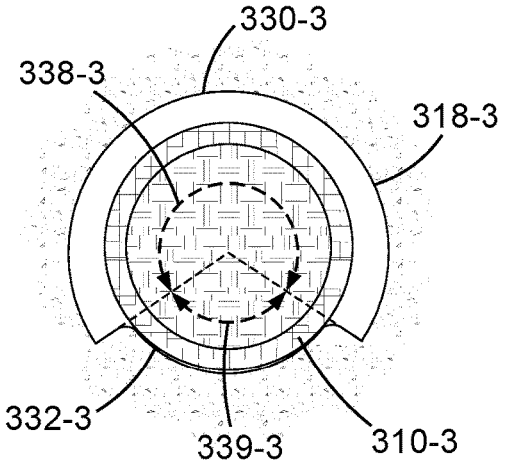

FIG. 3-1 shows an embodiment of a drill bit 310-1 disposed within an elongate hollow borehole 318-1 formed in the earth 316-1. The borehole 318-1 may comprise a central axis 335-1 passing therethrough and a cross-sectional shape formed within a plane perpendicular to the axis 335-1. A plurality of fixed cutters 321-1, capable of degrading the earth 316-1, may be disposed on the drill bit 310-1. These fixed cutters 321-1 may be spaced about the axis 335-1 to form an initially cylindrical borehole with a constant radius as the drill bit 310-1 is rotated. An extendable cutting element 322-1 may be extended from a side of the drill bit 310-1 to expand this initial borehole radius by removing additional earthen material from an internal wall of the borehole 318-1. This extendable cutting element 322-1 may be extended for only a fraction of a full rotation of the drill bit 310-1, before being retracted, such that this larger borehole radius is only present in an angular range of the borehole 318-1. Through this technique the borehole 318-1 may acquire a cross-sectional shape comprising two different circular arcs, each with a uniquely sized radius. In particular, a first circular arc 330-1, centered at the axis 335-1, may comprise a first radius 331-1, while a second circular arc 332-1, centered at the same axis 335-1, may comprise a second radius 333-1, smaller than the first radius 331-1.

FIG. 3-2 shows an embodiment of drilling tool 310-2 disposed within a non-circular borehole 318-2, similar to that shown in FIG. 3-1. The drilling tool 310-2 may comprise a cross section with a radius 334-2 that is smaller than the first radius 331-1, shown in FIG. 3-1, that was formed by extension of the extendable cutting element 322-1. This drilling tool 310-2 cross-sectional radius 334-2 may also be larger than the second radius 333-1 of FIG. 3-1 that was formed by the fixed cutters 321-1 of the drill bit 310-1. The drilling tool 310-2, in fact, may not fit through a borehole formed exclusively by the fixed cutters 321-1 without the enlargement created by the extendable cutting element 322-1. This sizing mismatch may constantly, and with little energy exerted by the drilling tool 310-2, urge the drilling tool 310-2 laterally (as indicated by arrow 340-2) as the smaller second radius 333-1 pushes the drilling tool 310-2 into space created by the larger first radius 331-1.

Also due to this size discrepancy, the drilling tool 310-2 may contact an internal wall of the borehole 318-2 generally at two points 336-2 and 337-2 of the cross section shown. These two points 336-2, 337-2 may be located on the smaller second radius 333-1. Limiting contact generally to two points may reduce friction between the drilling tool 310-2 and the borehole 318-2.

FIG. 3-3 shows an embodiment of a drilling tool 310-3 disposed within a non-circular borehole 318-3. In this embodiment, a first angular range 338-3 occupied by a first circular arc 330-3, forming part of a cross-sectional shape of the borehole 318-3, is larger than a second angular range 339-3 occupied by a second circular arc 332-3. The relative dimensions of these first and second angular ranges 338-3, 339-3 may be determined and adjusted by altering the timing of extension and retraction of an extendable cutting element as described in relation to FIG. 3-1.

Figures 3, 4:
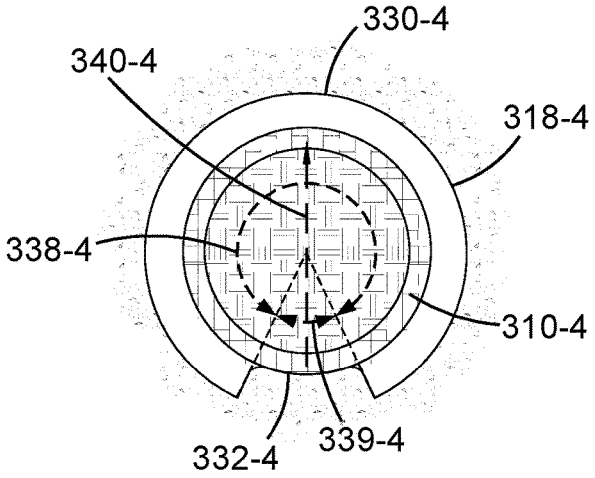
Figures 1, 4:
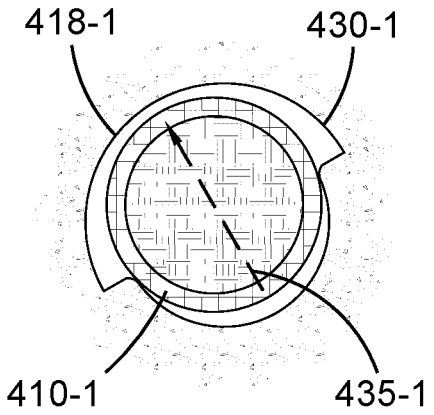
Figures 2, 4:
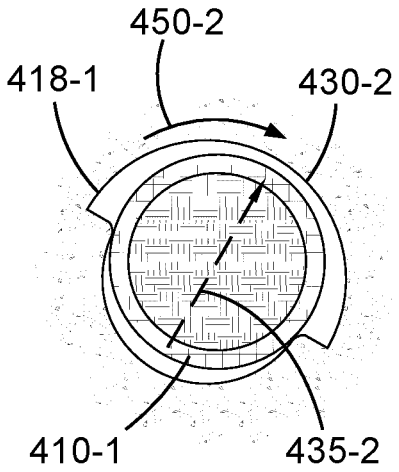
Figures 3, 4:
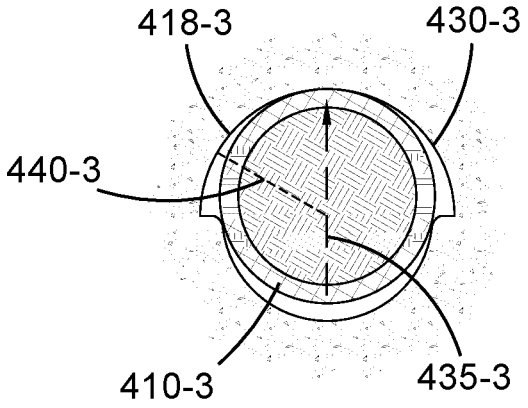
Figure 4:
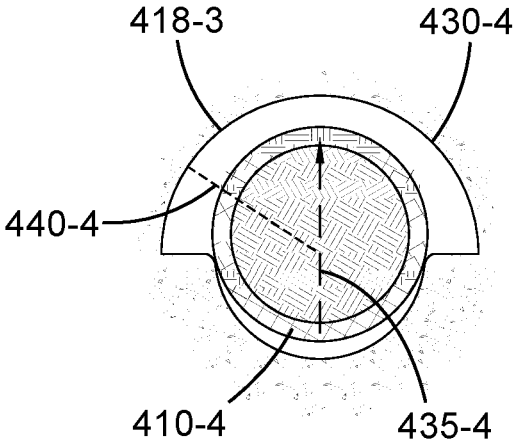

FIG. 3-4 shows another embodiment of a drilling tool 310-4 disposed within a non-circular borehole 318-4. In this embodiment, first and second angular ranges 338-4, 339-4, occupied by first and second circular arcs 330-4, 332-4, are even more divergent in relative size than those shown in previous embodiments. As the second angular range 339-4 decreases in size relative to the first angular range 338-4, a lateral urging (as indicated by arrow 340-4) of the borehole 318-4 against the drilling tool 310-4 may decrease as well. Thus, a rate of steering of a drill bit as it forms a borehole through the earth may be controlled by altering timing of extension and retraction of extendable cutting elements.

FIGS. 4-1 and 4-2 show an embodiment of a single subterranean borehole 418-1 at different positions along its length. At a first position along a length of the borehole 418-1, shown in FIG. 4-1, a cross section of the borehole 418-1 may comprise a first circular arc 430-1 positioned at a first rotational orientation. In this orientation, a drilling tool 410-1 disposed within the borehole 418-1 may be urged (as indicated by arrow 435-1) toward the first circular arc 430-1. At a second position along the borehole 418-1 length, shown in FIG. 4-2, a rotational orientation of a first circular arc 430-2 may be rotated relative to the first circular arc 430-1 shown in FIG. 4-1 (as indicated by arrow 450-2). This reorientation of the first circular arc 430-2 may cause the borehole 418-1 to urge the drilling tool 410-1 in a different direction (as indicated by arrow 435-2). Thus, by adjusting the rotational orientation of a borehole's circular arcs, a drilling tool may be urged in various azimuthal directions.

FIGS. 4-3 and 4-4 show an embodiment of a single subterranean borehole 418-3 at different positions along its length. At a first position along a length of the borehole 418-3, shown in FIG. 4-3, a cross section may comprise a first circular arc 430-3 comprising a first radius 440-3. A drilling tool 410-3 disposed within the borehole 418-3 may be urged (as indicated by arrow 435-3) toward the first circular arc 430-3. At a second position along the borehole 418-3 length, shown in FIG. 4-4, a radius 440-4 of a first circular arc 430-4 may be enlarged relative to the radius 440-3 of the first circular arc 430-3 shown in FIG. 4-3. This resizing of the radius 440-4 may steer the borehole 418-3 in a tighter radius of curvature.

Figure 5:
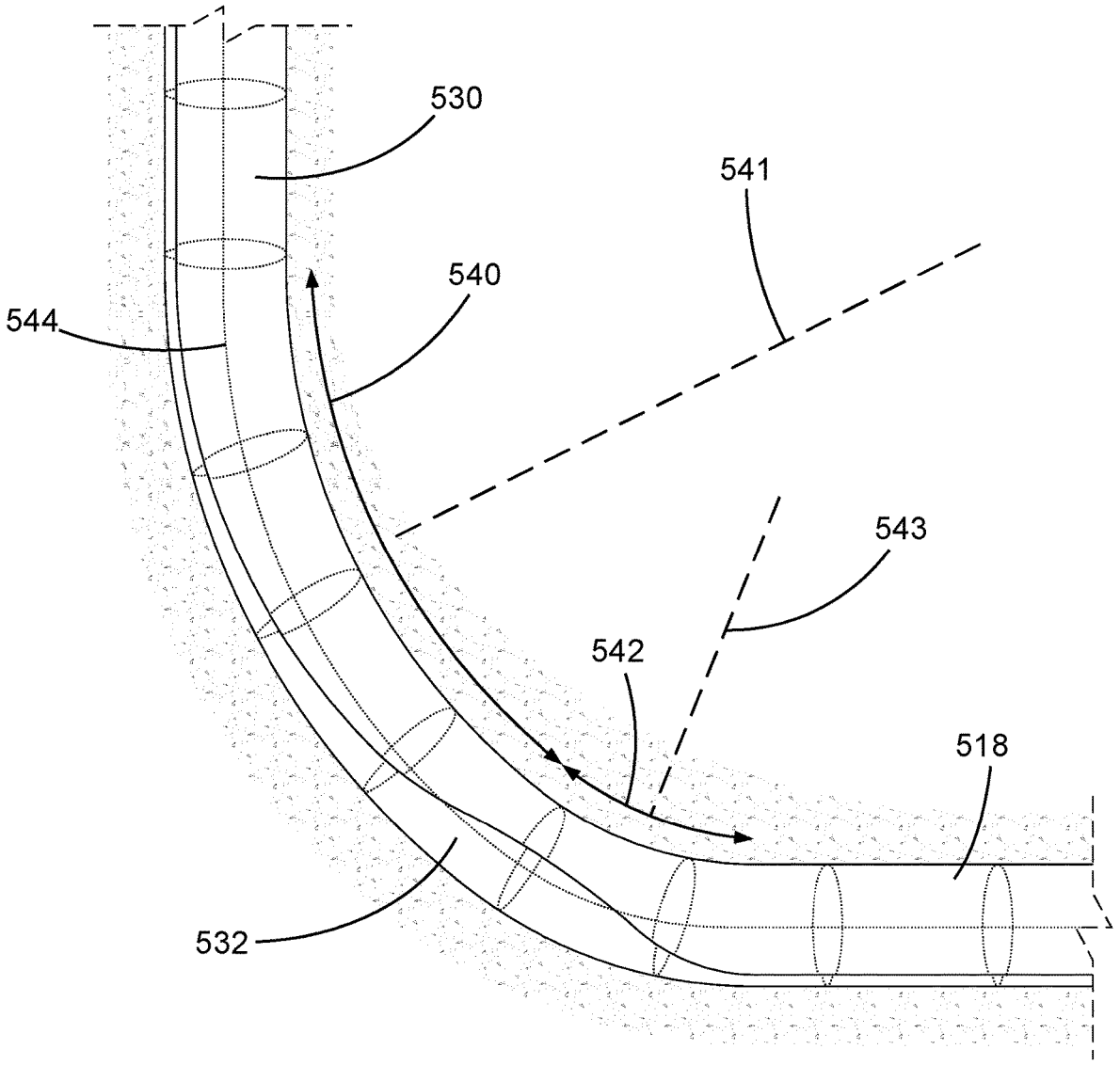
FIG. 5 is an orthogonal view of an embodiment of a non-circular subterranean borehole.

FIG. 5 shows an embodiment of a section of elongate hollow borehole 518 formed in an earthen formation. This borehole 518 may have an axis 544 passing therethrough and a cross-sectional shape comprising first and second circular arcs 530, 532 of distinct radii centered at the axis 544. These first and second circular arcs 530, 532 may be adjusted relative to each other in both radii, angular size and rotational orientation during drilling such that they differ at various points along a length of the borehole 518. By adjusting these first and second circular arcs 530, 532 as drilling progresses, the borehole 518 may be formed to comprise multiple curves along its axis 544. These various curves may comprise unique radii of curvature based on the relative dimensions of the first and second circular arcs 530, 532 and the lateral urging forces created thereby. For example, a first curve 540 of the borehole 518, curving toward the first circular arc 530, may comprise a first radius of curvature 541. The size of this first radius of curvature 541 may depend on the relative radii and angular sizes of the first and second circular arcs 530, 532. If this first radius of curvature 541 is not changing a direction of the borehole 518 as rapidly as desirable, then the relative dimensions of the first and second circular arcs 530, 532 may be altered, thus resulting in an increased urging force. For instance, in a second curve 542 of the borehole 518, an angular size of the first circular arc 530 may be reduced while an angular size of the second circular arc 532 may be expanded. By so doing, a second radius of curvature 543 within the second curve 542 may be smaller than the first radius of curvature 541 leading to a more rapid change of direction.

Whereas this discussion has referred to the figures attached hereto, it should be understood that other and further modifications apart from those shown or suggested herein, may be made within the scope and spirit of the present disclosure.

The invention claimed is:

1. A subterranean borehole, comprising:

an internal wall formed within an earthen formation defining an elongate hollow;

the wall delineating a cross-sectional shape within a plane perpendicular to an axis passing through the hollow;

the cross-sectional shape comprising first and second circular arcs, both centered at the axis but comprising distinct radii; and a drilling tool disposed within the hollow; wherein a radius of the first circular arc is larger than a cross-sectional radius of the drilling tool and a radius of the second circular arc is smaller than the cross-sectional radius of the drilling tool.

2. The subterranean borehole of claim 1, wherein the internal wall contacts the drilling tool at two points of the cross-sectional shape.

3. The subterranean borehole of claim 2, wherein the two points are located on the second circular arc.

4. The subterranean borehole of claim 1, wherein the axis is curved; a radius of the first circular arc is larger than one of the second circular arc; and the first circular arc is closer to a center of curvature of the axis than the second circular arc.

5. The subterranean borehole of claim 1, wherein the first and second circular arcs occupy distinct angular ranges about the axis.

6. The subterranean borehole of claim 5, wherein the axis is curved and a radius of curvature of the axis is dependent on the relative dimensions of the radii or angular ranges of the first and second circular arcs.

7. The subterranean borehole of claim 5, wherein the radii or angular ranges of the first and second circular arcs vary in dimension at different positions along the axis.

8. The subterranean borehole of claim 5, wherein the angular ranges of the first and second circular arcs vary in rotational orientation about the axis at different positions along the axis.

9. A method for forming a subterranean borehole, comprising:

boring an elongate hollow within an earthen formation, comprising rotating a drilling tool, wherein the elongate hollow comprises an axis passing therethrough and a cross-sectional shape within a plane perpendicular to the axis; and removing earthen material from an internal wall of the hollow to create first and second circular arcs on the cross-sectional shape, both centered at the axis but comprising distinct radii, wherein removing earthen material from the internal wall to create the first circular arc comprises extending a cutting element from a side of the drilling tool during a first portion of rotation, and removing earthen material from the internal wall to create the second circular arc comprises retracting the cutting element during a second portion of rotation.

10. The method of claim 9, further comprising disposing the drilling tool, comprising a cross-sectional radius smaller than the first circular arc but larger than the second circular arc, within the hollow and forcing the drilling tool into the first circular arc with the second circular arc.

11. The method of claim 10, wherein the forcing of the drilling tool forms a curve in the axis as the hollow is bored.

12. The method of claim 10, further comprising adjusting the forcing of the drilling tool by altering distinct radii or angular ranges occupied by the first and second circular arcs.

13. The method of claim 12, wherein adjusting the forcing comprises altering a magnitude of force by altering respective dimensions of the radii or angular ranges of the first and second circular arcs.

14. The method of claim 12, wherein adjusting the forcing comprises altering a direction of force by altering respective rotational orientations about the axis of the angular ranges of the first and second circular arcs.

15. The method of claim 12, wherein adjusting the forcing of the drilling tool alters a curve in the axis as the hollow is bored.

16. The method of claim 9, further comprising altering timing of the cutting element extension and retraction to adjust angular ranges occupied by the first and second circular arcs.

17. The method of claim 16, further comprising decreasing a dimension of the angular range occupied by the first circular arc to decrease a radius of curvature of the axis.

18. The method of claim 9, further comprising altering depth of the cutting element extension and retraction to adjust radii occupied by the first and second circular arcs.

* * * * *